US009102486B2

(12) United States Patent
Yoshitsugu et al.

(10) Patent No.: US 9,102,486 B2
(45) Date of Patent: Aug. 11, 2015

(54) ACCOMMODATING DEVICE AND IMAGE FORMING APPARATUS

(71) Applicant: FUJI XEROX CO., LTD., Tokyo (JP)

(72) Inventors: Koji Yoshitsugu, Kanagawa (JP); Satoshi Fukada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/252,015

(22) Filed: Apr. 14, 2014

(65) Prior Publication Data

US 2015/0108713 A1 Apr. 23, 2015

(30) Foreign Application Priority Data

Oct. 18, 2013 (JP) ..... 2013-217671

(51) Int. Cl.

| | |
|---|---|
| ***B65H 1/24*** | (2006.01) |
| ***B65H 31/08*** | (2006.01) |
| ***B65H 1/04*** | (2006.01) |
| ***B65H 1/08*** | (2006.01) |
| ***B65H 1/14*** | (2006.01) |

(52) U.S. Cl.

CPC .. *B65H 1/24* (2013.01); *B65H 1/04* (2013.01); *B65H 1/08* (2013.01); *B65H 1/14* (2013.01); *B65H 31/08* (2013.01); *B65H 2405/11* (2013.01); *B65H 2405/1117* (2013.01)

(58) Field of Classification Search

CPC ..... B65H 1/00; B65H 1/04; B65H 1/08; B65H 1/14; B65H 1/24; B65H 2405/111; B65H 2405/1117

USPC ..... 271/147, 157, 152, 155, 156

See application file for complete search history.

(56) References Cited

U.S. PATENT DOCUMENTS

| | | | | |
|---|---|---|---|---|
| 4,535,982 | A * | 8/1985 | Mochimaru | 271/127 |
| 7,497,434 | B2 * | 3/2009 | Park | 271/127 |
| 7,503,558 | B2 * | 3/2009 | Kusumi | 271/152 |

FOREIGN PATENT DOCUMENTS

| | | | |
|---|---|---|---|
| JP | 03158325 | A * | 7/1991 |
| JP | A-2007-254144 | | 10/2007 |

* cited by examiner

*Primary Examiner* — Ernesto Suarez

(74) *Attorney, Agent, or Firm* — Oliff PLC

(57) ABSTRACT

An accommodating device includes an accommodating portion including a bottom portion and in which a member to be accommodated is accommodated, a stacking member disposed in the accommodating portion such that, while one end side of the stacking member serves as a fulcrum, the other end side thereof is able to move upward, and on which the member to be accommodated is stacked, a lifting/lowering mechanism that lifts the other end side and causes the stacking member to drop under its own weight by releasing a lifting force, and a buffer member that acts as a buffer between the stacking member and the bottom portion of the accommodating portion while being constantly in contact with a bottom surface of the stacking member and a top surface of the bottom portion of the accommodating portion within a movable range in which the lifting/lowering mechanism causes the stacking member to move.

20 Claims, 8 Drawing Sheets

ACCOMMODATING DEVICE AND IMAGE FORMING APPARATUS

CROSS-REFERENCE TO RELATED APPLICATIONS

This application is based on and claims priority under 35 USC 119 from Japanese Patent Application No. 2013-217671 filed Oct. 18, 2013.

BACKGROUND

Technical Field

The present invention relates to an accommodating device and an image forming apparatus.

SUMMARY

According to an aspect of the invention, there is provided an accommodating device including an accommodating portion that includes a bottom portion and in which a member to be accommodated is to be accommodated, a stacking member that is disposed in the accommodating portion in such a manner that, while one end side of the stacking member serves as a fulcrum, the other end side of the stacking member is able to move upward, and on which the member to be accommodated is to be stacked, a lifting/lowering mechanism that lifts the other end side of the stacking member and causes the stacking member to drop under a weight of the stacking member by releasing a lifting force, and a buffer member that acts as a buffer between the stacking member that is to drop under the weight of the stacking member and the bottom portion of the accommodating portion while being constantly in contact with a bottom surface of the stacking member and a top surface of the bottom portion of the accommodating portion within a movable range in which the lifting/lowering mechanism causes the stacking member to move.

BRIEF DESCRIPTION OF THE DRAWINGS

An exemplary embodiment of the present invention will be described in detail based on the following figures, wherein.

DETAILED DESCRIPTION

An example of an exemplary embodiment of the present invention will be described below with reference to the drawings.

(Configuration of Image Forming Apparatus 10)

Figure 1:
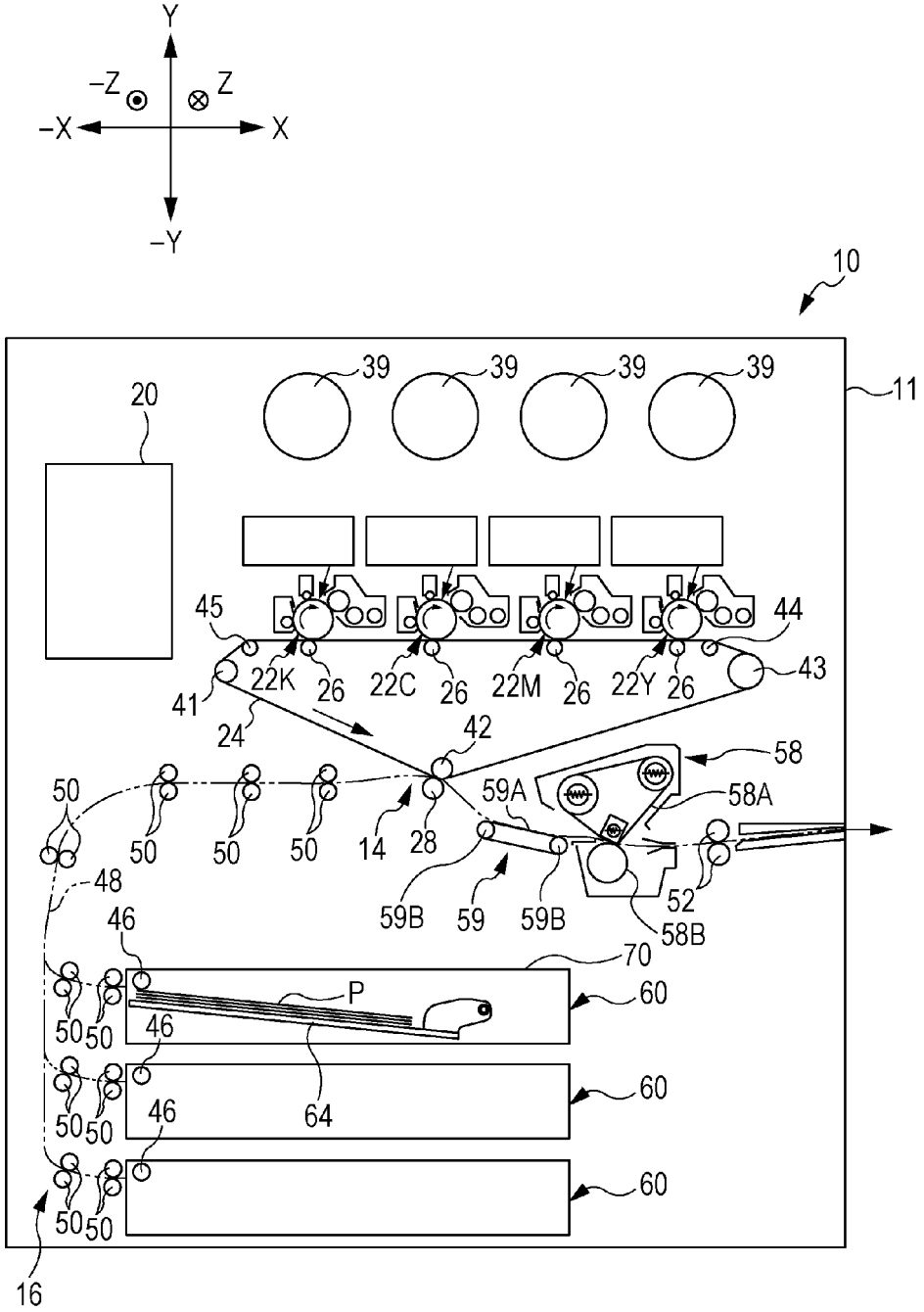
FIG. 1 is a schematic diagram illustrating the configuration of an image forming apparatus according to an exemplary embodiment of the present invention.

First, the configuration of an image forming apparatus 10 according to the exemplary embodiment will be described. FIG. 1 is a schematic diagram illustrating the configuration of the image forming apparatus 10. Note that the X direction, the −X direction, the Y direction (upward), the −Y direction (downward), the Z direction, and the −Z direction that will be used in the following description are the directions of arrows illustrated in the drawings. In the drawings, a symbol having "x" in "○" denotes an arrow extending from the proximal side toward the distal side as viewed in the drawings, and a symbol having "." in "○" denotes an arrow extending from the distal side toward the proximal side as viewed in the drawings.

As illustrated in FIG. 1, the image forming apparatus 10 includes an image forming apparatus body 11 (a housing) in which components are accommodated. Accommodating devices 60 in which recording media P (examples of members to be accommodated) such as sheets are to be accommodated, an image forming section 14 that forms an image on one of the recording media P, a transport mechanism 16 that transports one of the recording media P from one of the accommodating devices 60 to the image forming section 14, and a controller 20 that controls the operation of each unit of the image forming apparatus 10 are provided in the image forming apparatus body 11.

The image forming section 14 includes image forming units 22Y, 22M, 22C, and 22K (hereinafter referred to as image forming units 22Y to 22K) that form toner images of yellow (Y), magenta (M), cyan (C), and black (K) colors, an intermediate transfer belt 24 to which toner images that have been formed by the image forming units 22Y to 22K are to be transferred, first transfer rollers 26 that transfer toner images that have been formed by the image forming units 22Y to 22K onto the intermediate transfer belt 24, and a second transfer roller 28 that transfers toner images that have been transferred to the intermediate transfer belt 24 by the first transfer rollers 26 onto one of the recording media P from the intermediate transfer belt 24. Note that the image forming section 14 is not limited to have the above-described configuration and may have a different configuration as long as the image forming section 14 forms an image on one of the recording media P.

Figure 2:
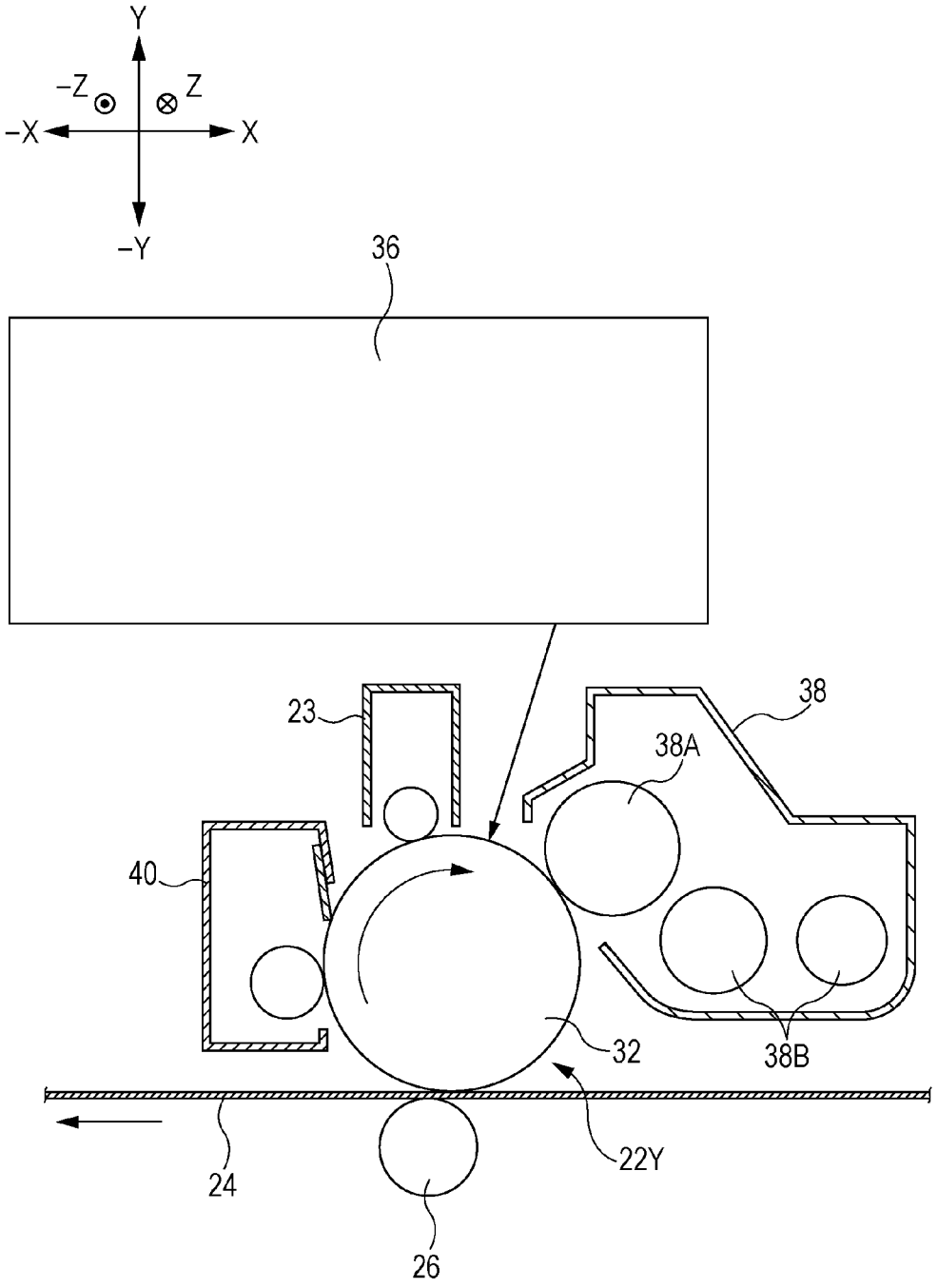
FIG. 2 is a schematic diagram illustrating the configuration of an image forming unit according to the exemplary embodiment.

The image forming units 22Y to 22K are arranged next to each other in the X direction and adjacent to (above) the intermediate transfer belt 24 in the Y direction. As illustrated in FIG. 2, each of the image forming units 22Y to 22K includes a photoconductor 32 that rotates in one direction (e.g., a clockwise direction in FIG. 2). Note that since the image forming units 22Y to 22K have the same configuration, FIG. 2 illustrates the configuration of the image forming unit 22Y as a representative example of the image forming units 22Y to 22K.

Around the periphery of each of the photoconductors 32, a charging device 23 that charges the photoconductor 32, an exposure device 36 that exposes the photoconductor 32 that has been charged by the charging device 23 to light and forms an electrostatic latent image on the photoconductor 32, a developing device 38 that develops an electrostatic latent image that has been formed on the photoconductor 32 by the exposure device 36 and forms a toner image, and a removal device 40 that removes toner that remains on the photoconductor 32 by making contact with the photoconductor 32 are disposed in order starting from an upstream side in a rotation direction of the photoconductor 32.

Each of the exposure devices 36 is configured to form an electrostatic latent image on the basis of an image signal that is sent from the controller 20 (see FIG. 1). An example of an image signal that is sent from the controller 20 is an image signal acquired by the controller 20 from an external apparatus.

Each of the developing devices 38 includes a developer supply body 38A that supplies a developer to the photoconductor 32 and transport members 38B that transport a developer, which is to be supplied to the developer supply body 38A, while stirring the developer.

As illustrated in FIG. 1, toner containing sections 39 that contain toners that are to be supplied to the developing devices 38 of the image forming units 22Y to 22K are disposed above the exposure devices 36.

The intermediate transfer belt 24 is formed into an annular shape and arranged adjacent to (below) the image forming units 22Y to 22K in the −Y direction. Winding rollers 41, 42, 43, 44, and 45 around which the intermediate transfer belt 24 is wound are disposed on the inner periphery side of the intermediate transfer belt 24. As an example, the intermediate transfer belt 24 moves circularly (rotates) in one direction (e.g., a counterclockwise direction in FIG. 1) while being in contact with the photoconductors 32 as a result of the winding roller 43 being driven so as to rotate. Note that the winding roller 42 serves as a counter that faces the second transfer roller 28.

Each of the first transfer rollers 26 faces a corresponding one of the photoconductors 32 with the intermediate transfer belt 24 interposed therebetween. The position between each of the first transfer rollers 26 and the corresponding photoconductor 32 is a first transfer position at which a toner image that has been formed on the photoconductor 32 is to be transferred onto the intermediate transfer belt 24.

The second transfer roller 28 faces the winding roller 42 with the intermediate transfer belt 24 interposed therebetween. The position between the second transfer roller 28 and the winding roller 42 is a second transfer position at which a toner image that has been transferred to the intermediate transfer belt 24 is to be transferred onto one of the recording media P.

The transport mechanism 16 includes delivery rollers 46 each of which sends out one of the recording media P that is accommodated in one of the accommodating devices 60, a transport path 48 along which the recording medium P that has been sent out by the delivery roller 46 is to be transported, and transport rollers 50 that are disposed along the transport path 48 and that transport the recording medium P, which has been sent out by the delivery roller 46, to the second transfer position. Each of the delivery rollers 46 is configured to send out one of the recording media P that are stacked on a bottom plate 64 of the corresponding accommodating device 60 from the corresponding accommodating portion 70 by making contact with a top surface of the recording medium P.

A transport member 59 that transports one of the recording media P to which a toner image has been transferred by the second transfer roller 28 is disposed on a downstream side of the second transfer position in a transport direction. The transport member 59 includes an annular (endless) transport belt 59A and a pair of rollers 59B around which the transport belt 59A is wound. As a result of at least one of the pair of rollers 59B being driven so as to rotate in a state where one of the recording media P is held on the outer peripheral surface of the transport belt 59A, the recording medium P is transported to a fixing device 58, which will be described below. Note that, as an example, the transport belt 59A is configured to hold one of the recording media P as a result of the recording medium P being drawn through intake holes that are formed in the transport belt 59A.

The fixing device 58 that fixes a toner image that has been transferred to one of the recording media P by the second transfer roller 28 onto the recording medium P is disposed on a downstream side of the transport member 59 in the transport direction. In the fixing device 58, a fixing belt 58A heats a toner image, and a pressure roller 58B applies pressure to the toner image, so that the toner image is fixed onto one of the recording media P that has been transported from the transport member 59.

Ejection rollers 52 that eject one of the recording media P on which a toner image has been fixed to an ejecting section (not illustrated) are disposed on a downstream side of the fixing device 58 in the transport direction.

(Image Forming Operation)

An image forming operation in which an image is formed on one of the recording media P in the image forming apparatus 10 according to the exemplary embodiment will now be described.

In the image forming apparatus 10 according to the exemplary embodiment, one of the recording media P that has been sent out from one of the accommodating devices 60 by the corresponding delivery roller 46 is transported by the transport rollers 50. The recording medium P that has been transported by the transport rollers 50 is sent into the second transfer position.

On the other hand, in each of the image forming units 22Y to 22K, the photoconductor 32 that has been charged by the charging device 23 is exposed to light by the exposure device 36, and as a result, an electrostatic latent image is formed on the photoconductor 32. The electrostatic latent image is developed by the developing device 38, and as a result, a toner image is formed on the photoconductor 32. Toner images of different colors that have been formed by the image forming units 22Y to 22K are superposed with one another on the intermediate transfer belt 24 at the first transfer position, and as a result, a color image is formed. Then, the color image that has been formed on the intermediate transfer belt 24 is transferred onto the recording medium P at the second transfer position.

The recording medium P to which the toner image has been transferred is transported to the fixing device 58 by the transport member 59, and the toner image, which has been transferred to the recording medium P, is fixed onto the recording medium P by the fixing device 58. The recording medium P to which the toner image has been fixed is ejected from the image forming apparatus body 11 to the ejecting section (not illustrated) by the ejection rollers 52. A series of image forming operations are performed in the manner described above.

(Configuration of Accommodating Device 60)

Figure 3:
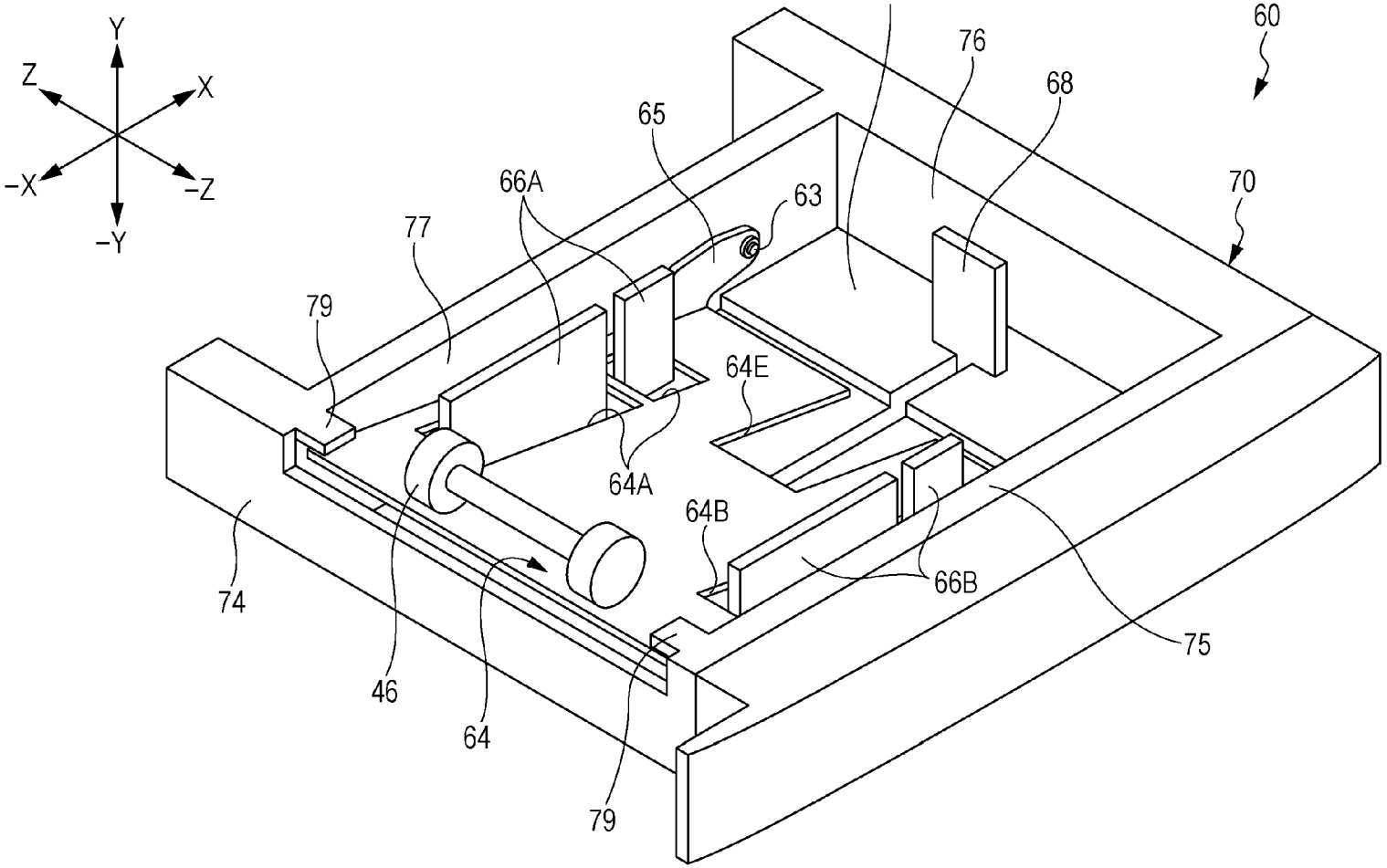
FIG. 3 is a perspective view illustrating the configuration of one of accommodating devices according to the exemplary embodiment.
Figure 4:
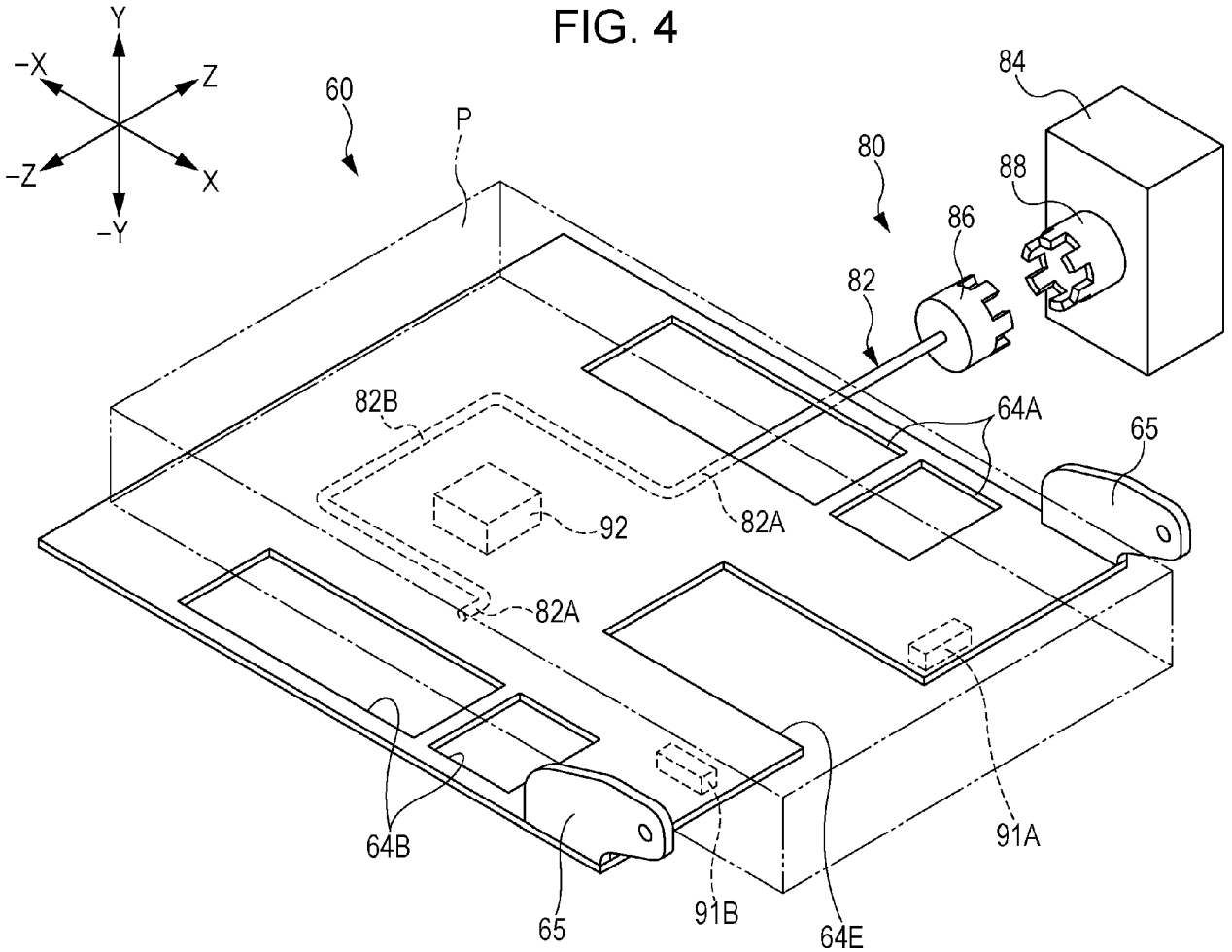
FIG. 4 is a perspective view illustrating part of the configuration of the accommodating device according to the exemplary embodiment.
Figure 5:
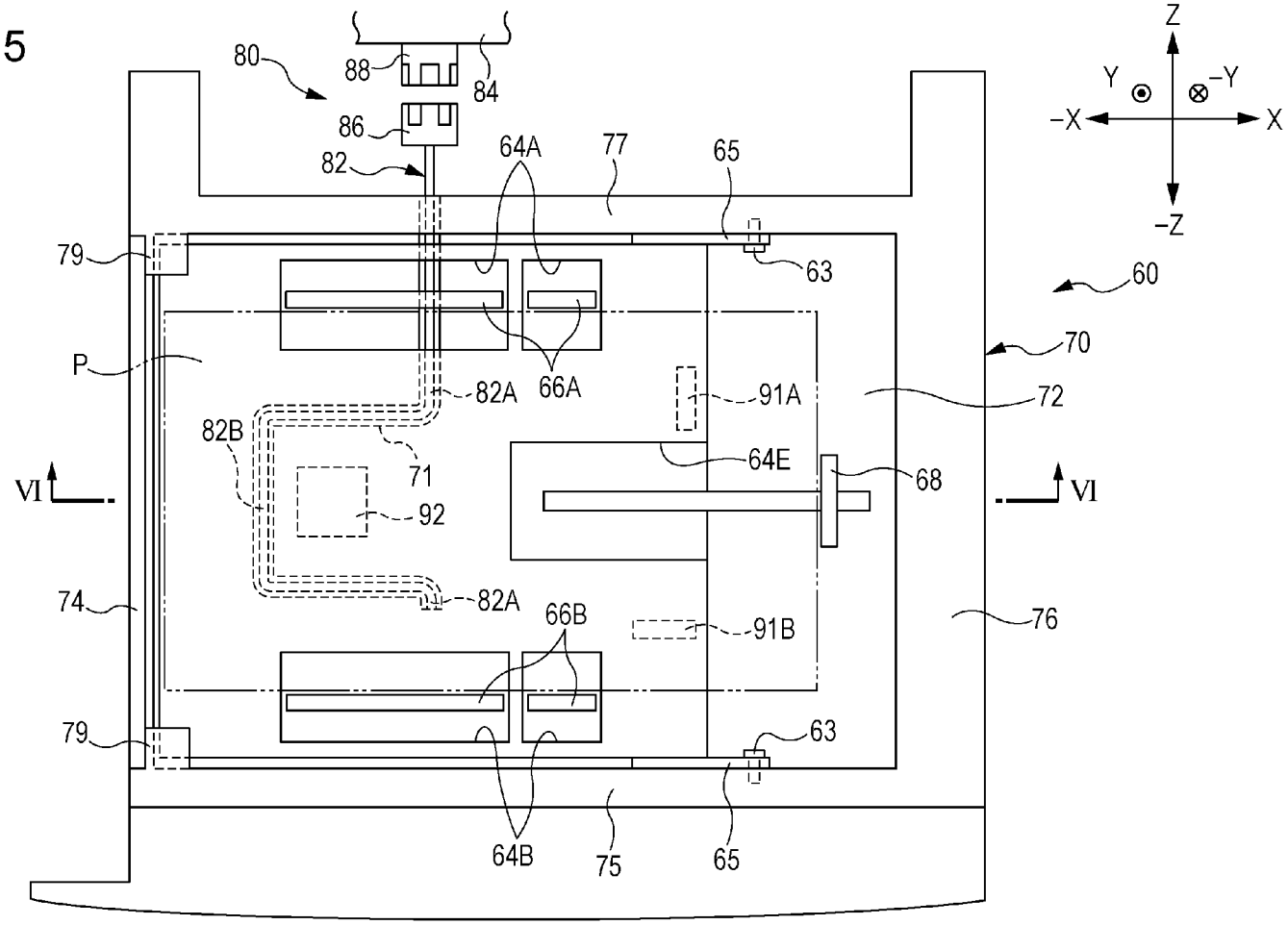
FIG. 5 is a plan view illustrating the configuration of the accommodating device according to the exemplary embodiment.
Figure 6:
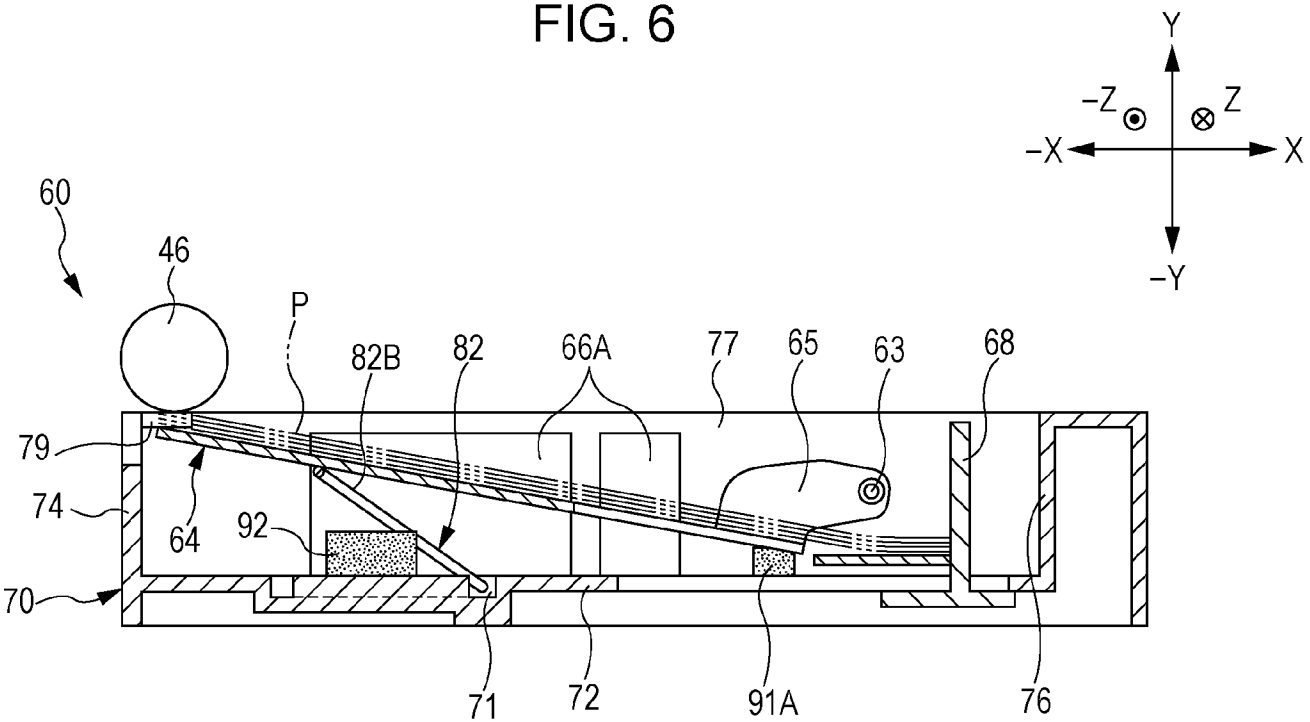
FIG. 6 is a sectional side view (a sectional view taken along line VI-VI of FIG. 5) illustrating the configuration of the accommodating device according to the exemplary embodiment.
Figure 7:
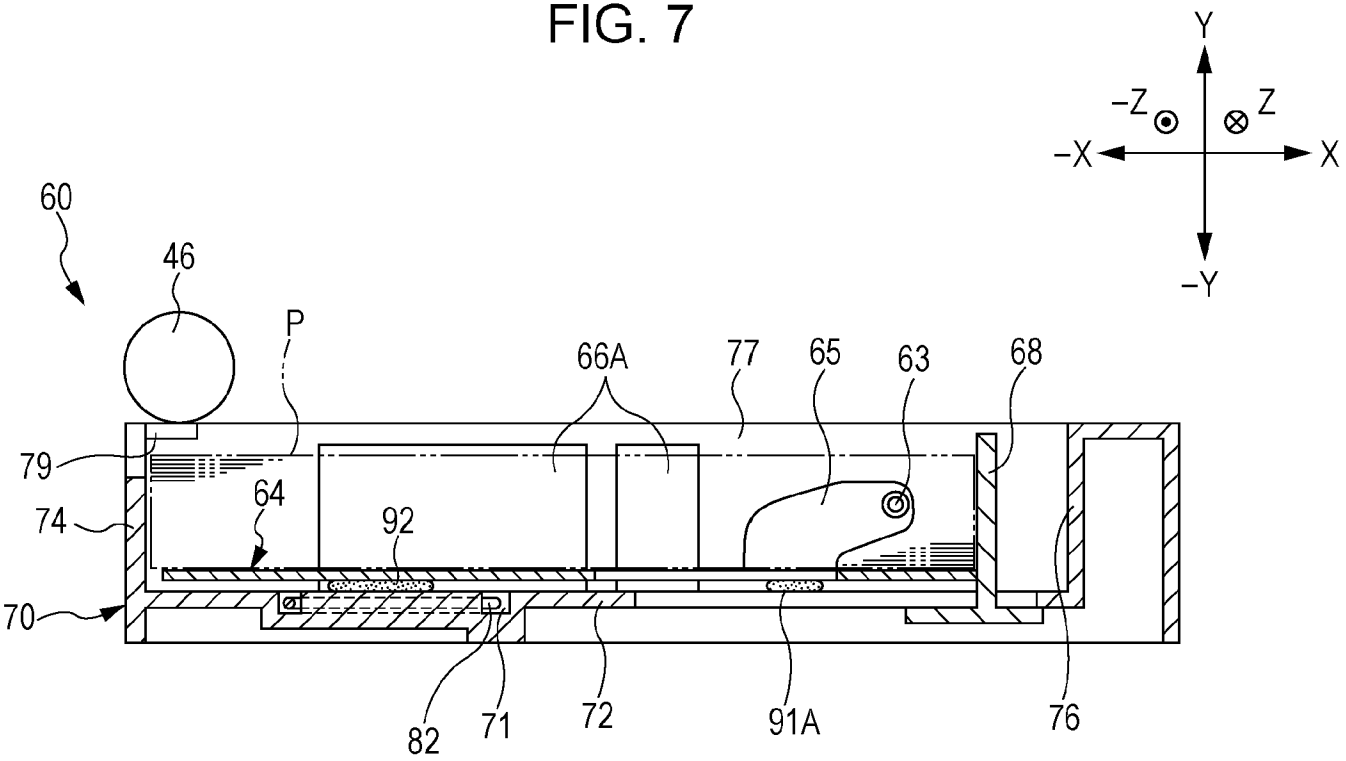
FIG. 7 is a sectional side view illustrating a state where a bottom plate has descended in the accommodating device illustrated in FIG. 6.

The configuration of each of the accommodating devices 60 (sheet feed cassettes) will now be described. FIG. 3 is a perspective view of one of the accommodating devices 60. FIG. 4 is a perspective view illustrating part of the configuration of the accommodating device 60. FIG. 5 is a plan view of the accommodating device 60. FIG. 6 and FIG. 7 are sectional side views of the accommodating device 60 (sectional views taken along line VI-VI of FIG. 5).

As illustrated in FIG. 3, the accommodating device 60 includes the accommodating portion 70 (an accommodating device body) in which the recording media P (examples of members to be accommodated) are accommodated. The accommodating device 60 (the accommodating portion 70) is disposed in such a manner as to be drawable in the −Z direction and to be mountable in the Z direction with respect to the image forming apparatus body 11 (see FIG. 1). Note that the accommodating device 60 (the accommodating portion 70) may be removed from the image forming apparatus body 11 by being drawn from the image forming apparatus body 11 in the −Z direction.

The accommodating portion 70 is formed in such a manner as to have the shape of a box that is open at the top. In other words, the accommodating portion 70 includes a bottom wall 72 (an example of a bottom portion) and four side walls 74, 75, 76, and 77 that are disposed on portions of the bottom wall 72 on the −X direction side, the −Z direction side, the X direction side, and the Z direction side, respectively. The bottom plate 64 that is an example of a stacking member on which the recording media P that are accommodated in the accommodating portion 70 are stacked is disposed in an area inside the accommodating portion 70.

In addition, side guides 66A and 66B that function as a pair of positioning members that cause the recording media P, which are stacked on the bottom plate 64, to be positioned in a width direction of the recording media P (the Z direction) by making contact with ends in the width direction (side ends) of the recording media P and an end guide 68 that functions as a positioning member that causes the recording media P, which are stacked on the bottom plate 64, to be positioned in the transport direction of the recording media P (the −X direction) by making contact with rear ends (ends in the X direction) of the recording media P are disposed in an area inside the accommodating portion 70.

A cutout portion 64E that enables the end guide 68 to be movable in the −X direction beyond the end of the bottom plate 64 on the X direction side is formed in an end portion of the bottom plate 64 on the X direction side. Hole portions (cutout portions) 64A and 64B that enable the side guides 66A and 66B to be movable in the Z direction and the −Z direction are formed in an end portion of the bottom plate 64 on the Z direction side and an end portion of the bottom plate 64 on the −Z direction side, respectively.

An attachment portion (a hinge portion) 65 (see FIG. 4) is vertically formed on portions of the bottom plate 64 on the X direction side, one of the portions facing the Z direction, and the other one of the portions facing the −Z direction, and the attachment portions 65 are used for rotatably mounting the bottom plate 64 on the side walls 75 and 77 of the accommodating portion 70. Each of the attachment portions 65 is rotatably supported by a corresponding one of shaft portions 63, so that while an end portion of the bottom plate 64 on the X direction side (one end side) serves as a fulcrum (center of rotation), an end portion of the bottom plate 64 on the −X direction side (the other end side) may move upward.

As illustrated in FIG. 3, a control portion 79 that controls elevation of the bottom plate 64 is formed on each of the side wall 75 and the side wall 77 of the accommodating portion 70. A portion of the top surface of the bottom plate 64 on the −X direction side makes contact with the control portions 79, so that the bottom plate 64 is controlled so as not to move upward beyond the position at which the bottom plate 64 makes contact with the control portions 79.

This enables the end portion of the bottom plate 64 on the −X direction side to move up and down within an area between the bottom wall 72 and the control portions 79 of the accommodating portion 70.

In addition, as illustrated in FIG. 4 and FIG. 5, the accommodating portion 70 is provided with a lifting/lowering mechanism 80 that lifts and lowers a portion of the bottom plate 64 on the −X direction side. The lifting/lowering mechanism 80 includes a lifting member 82 that lifts up the portion of the bottom plate 64 on the −X direction side, a drive motor 84 that generates a driving force that causes the lifting member 82 to rotate, and a pair of couplings 86 and 88 that function as transmission members that are used for transferring a driving force of the drive motor 84 to the lifting member 82.

The lifting member 82 includes a shaft portion 82A that is rotatably supported by the bottom wall 72 of the accommodating portion 70 and a rising portion 82B that has a U-shape when viewed in plan and that rotates around the axis of the shaft portion 82A and rises from the bottom wall 72. As illustrated in FIG. 5 and FIG. 6, a groove 71 in which the shaft portion 82A and the rising portion 82B of the lifting member 82 are to be disposed is formed in the bottom wall 72.

As illustrated in FIG. 4 and FIG. 5, the coupling 86 is fixed to an end of the shaft portion 82A on the Z direction side. The coupling 88 and the drive motor 84 are disposed in the image forming apparatus body 11. The coupling 88 is driven by a driving force of the drive motor 84 so as to rotate.

The lifting/lowering mechanism 80 has a configuration in which the coupling 86 is connected to and disconnected from the coupling 88 in an axial direction (the Z direction) as a result of the accommodating device 60 (the accommodating portion 70) being drawn from and being mounted in the image forming apparatus body 11.

In the lifting/lowering mechanism 80, in a state where the coupling 88 and the coupling 86 are connected to each other, the shaft portion 82A of the lifting member 82 is rotated by a driving force of the drive motor 84, and the rising portion 82B rises in such a manner as to lift up the bottom plate 64. As a result, the portion of the bottom plate 64 on the −X direction side moves upward and lifts the recording media P up to a position at which the recording medium P is brought into contact with the corresponding delivery roller 46 (a transport member) (see FIG. 6).

In a state where the coupling 88 and the coupling 86 are connected to each other, a load that acts on the rising portion 82B from the bottom plate 64 is supported by the drive motor 84, and as a result, the portion of the bottom plate 64 on the −X direction side is maintained in a raised state.

On the other hand, in a state where the coupling 88 and the coupling 86 are disconnected from each other as a result of the accommodating device 60 (the accommodating portion 70) being drawn from the image forming apparatus body 11, a supporting force (a lifting force) that maintains the portion of the bottom plate 64 on the −X direction side at a raised position is released, and as illustrated in FIG. 7, the bottom plate 64 drops under its own weight. Note that, in the case where the accommodating device 60 (the accommodating portion 70) is drawn from the image forming apparatus body 11 in a state where the recording media P are stacked on the bottom plate 64, the bottom plate 64 drops under the weight of the bottom plate 64 and the weight of the recording media P.

Note that drive transmission may be performed between the coupling 86 and the lifting member 82 via one or more gears. Similarly, drive transmission may be performed between the coupling 88 and the drive motor 84 via one or more gears.

Here, in the exemplary embodiment, as illustrated in FIG. 4, FIG. 5, and FIG. 6, buffer members 91A, 91B, and 92 that buffer between the bottom plate 64, which drops under its own weight, and the bottom wall 72 of the accommodating portion 70 are disposed on the bottom wall 72. Each of the buffer members 91A, 91B, and 92 is fixed to the bottom wall 72 by, for example, an adhesive, a double-sided adhesive tape, or the like. Note that each of the buffer members 91A, 91B, and 92 is not fixed to the bottom plate 64.

More specifically, as illustrated in FIG. 5, the buffer member 91A (an example of a first buffer member) is disposed on the bottom wall 72 in such a manner as to face a portion of the bottom surface of the bottom plate 64 on the X direction side, the portion of the bottom surface being adjacent to the cutout portion 64E in the Z direction.

More specifically, as illustrated in FIG. 5, the buffer member 91B (an example of the first buffer member) is disposed on the bottom wall 72 in such a manner as to face a portion of the bottom surface of the bottom plate 64 on the X direction side, the portion of the bottom surface being adjacent to the cutout portion 64E in the −Z direction.

The length in the top-bottom direction (the length in a height direction) of the buffer member 91A in an unloaded state is set to be larger than a length corresponding to a movable range in which the lifting/lowering mechanism 80 causes the bottom plate 64 (a portion of the bottom plate 64 facing the buffer member 91A) to move up and down. As a result, as illustrated in FIG. 6, the buffer member 91A is constantly in contact with a portion of the bottom surface of the bottom plate 64 on the X direction side and the top surface of the bottom wall 72 while compression deformation is occurring in the buffer member 91A within the movable range of the bottom plate 64. Note that the unloaded state is a state where the buffer member 91A does not receive a load (an external force) from the outside, and more specifically, a state where the buffer member 91A does not receive a load (an external force) from the bottom plate 64. The same configuration applies hereinafter. Alternatively, at least a portion of the top surface of the buffer member 91A may be constantly in contact with the bottom plate 64.

The buffer member 91B has a configuration that is similar to that of the buffer member 91A, and the length in the top-bottom direction of the buffer member 91B in an unloaded state is set to be larger than a length corresponding to a movable range of the bottom plate 64 (a portion of the bottom plate 64 facing the buffer member 91B). As a result, the buffer member 91B is constantly in contact with a portion of the bottom surface of the bottom plate 64 on the X direction side and the top surface of the bottom wall 72 while compression deformation is occurring in the buffer member 91B within the movable range of the bottom plate 64.

More specifically, as illustrated in FIG. 5, the buffer member 92 (an example of a second buffer member) is disposed on the bottom wall 72 in such a manner as to face a bottom surface of a portion of the bottom plate 64 on the −X direction side, which is a center portion of the bottom plate 64 in a width direction (the Z direction). More specifically, the buffer member 92 is disposed in an area inside the rising portion 82B in plan view in a state where the rising portion 82B having a U-shape of the lifting member 82 is disposed in the groove 71 of the bottom wall 72. As a result, the buffer member 92 is disposed between a portion of the bottom surface of the bottom plate 64 on the −X direction side and the top surface of the bottom wall 72 that faces the bottom surface.

As illustrated in FIG. 6, the length in the top-bottom direction of the buffer member 92 in an unloaded state is set to be smaller than a length corresponding to a movable range of the bottom plate 64 (a portion of the bottom plate 64 facing the buffer member 92). As a result, the buffer member 92 is separated from the bottom plate 64 when the bottom plate 64 is positioned higher than the position of the top surface of the buffer member 92 in an unloaded state (see FIG. 6), and the buffer member 92 is brought into contact with the bottom plate 64 when the bottom plate 64 is positioned lower than the position of the top surface of the buffer member 92 in an unloaded state (see FIG. 7). In other words, unlike the buffer members 91A and 91B, the buffer member 92 changes its state into a contact state in which the buffer member 92 is in contact with the bottom plate 64 (see FIG. 7) or a non-contact state in which the buffer member 92 is not in contact with the bottom plate 64 (see FIG. 6) within the movable range in which the lifting/lowering mechanism 80 causes the bottom plate 64 to move up and down.

As illustrated in FIG. 6, the length in the top-bottom direction of the buffer member 92 in an unloaded state is set to be larger than the length in the top-bottom direction of each of the buffer members 91A and 91B in an unloaded state.

In the exemplary embodiment, the length in the top-bottom direction and the like of the buffer members 91A, 91B, and 92 are adjusted in such a manner that the elastic deformation of the buffer members 91A, 91B, and 92 due to a load from the bottom plate 64 is saturated in a state where the bottom plate 64 that has dropped under its own weight is separated from the bottom wall 72. In some cases, a portion of the bottom plate 64 that has dropped under its own weight and the bottom wall 72 are brought into contact with each other depending on the basis weight and the size of each of the recording media P, deflection that occurs in the bottom plate 64 as a result of stacking the recording media P thereon, and so forth. However, at least in a state where the recording media P are not stacked on the bottom plate 64, the length in the top-bottom direction and the like of the buffer members 91A, 91B, and 92 are adjusted in such a manner that the elastic deformation of the buffer members 91A, 91B, and 92 due to a load from the bottom plate 64 is saturated in a state where the bottom plate 64 is separated from the bottom wall 72. As a result, as illustrated in FIG. 7, the buffer members 91A, 91B, and 92 support the bottom plate 64 that has dropped under its own weight in a state where the bottom plate 64 is separated from the bottom wall 72. Note that while common A4 normal sheets each having a basis weight of about 60 to 70 g/m$^2$ are used as the recording media P, when the bottom plate 64 on which the maximum stackable number of the recording media P are stacked is supported by the buffer members 91A, 91B, and 92, the bottom plate 64 is in a state of being parallel to the bottom wall 72 (the X direction).

Each of the buffer members 91A, 91B, and 92 is configured to acts as a buffer by generating internal damping along with deformation thereof, and as an example, an elastic member that is made of a porous material (a sponge material) such as semirigid urethane foam or flexible urethane foam is used as each of the buffer members 91A, 91B, and 92. Note that, in general, a buffer member (an impact absorption member) is made of semirigid urethane foam. Flexible urethane foam is low-resilience foam (a low-resilience material) that has smaller elasticity and a higher viscosity than semirigid urethane foam, and an example of such a flexible urethane foam is microcell UBT (manufactured by Bridgestone Corporation). Flexible urethane foam takes a longer time to return to its original shape after elastic compression deformation has occurred therein than semirigid urethane foam does. Note that each of the buffer members 91A, 91B, and 92 may be formed of a pleated tube that is made of a resin material as long as each of the buffer members 91A, 91B, and 92 functions as a buffer between the bottom plate 64 that is to drop under its own weight and the bottom wall 72. In the exemplary embodiment, each of the buffer members 91A and 91B is made of semirigid urethane foam, and the buffer member 92 is made of flexible urethane foam. Note that the buffer members 91A, 91B, and 92 may be made of the same material. Alternatively, the buffer members 91A, 91B, and 92 may be made of different materials, or each of the buffer members 91A, 91B, and 92 may include a portion that is made of a material different from the material out of which the rest of the buffer member is made.

(Effects of Exemplary Embodiment)

Effects of the exemplary embodiment will now be described.

When one of the accommodating devices 60 that has the corresponding bottom plate 64 being at a raised position (see FIG. 6) is drawn from the image forming apparatus body 11 (see FIG. 1) in the −Z direction, as illustrated in FIG. 5, the corresponding couplings 88 and 86 are brought into a state of not being connected with each other. As a result, a supporting force (a lifting force) that maintains a portion of the bottom plate 64 on the −X direction side at a raised position is released, and as illustrated in FIG. 7, the bottom plate 64 drops under its own weight.

Here, in the exemplary embodiment, since each of the buffer members 91A and 91B is constantly in contact with a portion of the bottom surface of the bottom plate 64 on the X direction side and the top surface of the bottom wall 72, even if the bottom plate 64 descends from any position within the movable range of the bottom plate 64, the buffering action caused by the buffer members 91A and 91B acts on the bottom plate 64. In other words, even if the bottom plate 64 descends from any position within the movable range of the bottom plate 64, the bottom plate 64 will not fall freely, and the fall velocity of the bottom plate 64 is reduced.

When the bottom plate 64 further drops under its own weight, the bottom plate 64 comes into contact with the buffer member 92, and the buffering action caused by the buffer member 92 acts on the bottom plate 64.

As described above, even if the bottom plate 64 descends from any position within the movable range of the bottom plate 64, buffering action caused by the buffer members 91A and 91B acts on the bottom plate 64, and thus, an impact due to collision between the bottom plate 64 and the bottom wall 72 of the accommodating portion 70 is reduced, and collision sound (impact sound) is suppressed regardless of the position (level) of the bottom plate 64 as compared with the case where the buffer members 91A and 91B are not configured to be constantly in contact with the bottom plate 64 and the bottom wall 72.

In addition, as described above, in the exemplary embodiment, the buffer member 92, which is disposed on a portion of the bottom plate 64 on the −X direction side, is not in contact with the bottom plate 64 at an early stage of the downward movement of the bottom plate 64 and is brought into contact with the bottom plate 64 at an advanced stage of the downward movement of the bottom plate 64. Therefore, according to the configuration of the exemplary embodiment, an impact due to collision between the bottom plate 64 and the bottom wall 72 of the accommodating portion 70 is reduced without hindering the downward movement of the bottom plate 64 at an early stage as compared with the case where the buffer member 92 is constantly in contact with the bottom plate 64 and the bottom wall 72.

As described above, the downward movement of the bottom plate 64 at an early stage is not be hindered, so that when the accommodating device 60 is drawn from the image forming apparatus body 11, the recording media P are quickly accommodated in the accommodating portion 70, and occurrence of contacts between the recording media P and the members of the image forming apparatus body 11 is suppressed.

In addition, in the exemplary embodiment, since the length in the top-bottom direction of the buffer member 92 is longer than the length in the top-bottom direction of each of the buffer members 91A and 91B, the fall velocity of the bottom plate 64 is effectively reduced at an advanced stage of the downward movement of the bottom plate 64, and an impact due to collision between the bottom plate 64 and the bottom wall 72 of the accommodating portion 70 is reduced as compared with the case where the length in the top-bottom direction of the buffer member 92 is not more than the length in the top-bottom direction of each of the buffer members 91A and 91B.

In addition, in the exemplary embodiment, the buffer members 91A, 91B and 92 support the bottom plate 64 that has dropped under its own weight in a state where the bottom plate 64 is separated from the bottom wall 72. Therefore, an impact due to collision between the bottom plate 64 and the bottom wall 72 of the accommodating portion 70 is reduced as compared with the case where the buffer members 91A, 91B and 92 support the bottom plate 64 that has dropped under its own weight in a state where the bottom plate 64 is in contact with the bottom wall 72.

In the exemplary embodiment, the buffer members 91A and 91B are disposed on the side of a portion of the bottom plate 64 on the X direction side that serves as the center of rotation. In other words, the buffer members 91A and 91B are disposed on the side of a portion of the bottom plate 64 on the X direction side that has a smaller movable range than that of a portion of the bottom plate 64 on the −X direction side. Thus, the deformation range of each of the buffer members 91A and 91B that are constantly in contact with the bottom plate 64 and the bottom wall 72 is small as compared with the case where the buffer members 91A and 91B are disposed on the side of a portion of the bottom plate 64 on the −X direction side that has a larger movable range. Therefore, the degree of freedom in selecting material becomes larger, and deterioration of the buffer members 91A and 91B is suppressed.

In the exemplary embodiment, particularly the buffer member 92 is made of a low-resilience material (flexible urethane foam). In the case where a member that is made of common semirigid urethane foam is disposed at a position at which the buffer member 92 is to be disposed, the member, which is made of common semirigid urethane foam, may act like a spring and push the bottom plate 64 that is dropping under its own weight upward. In the exemplary embodiment, occurrence of rebound of the bottom plate 64 is suppressed by making the buffer member 92 out of a low-resilience material.

(Modifications)

Although the buffer members 91A, 91B, and 92 are fixed to the bottom wall 72 of the accommodating portion 70 in the exemplary embodiment, the buffer members 91A, 91B, and 92 may be fixed to the bottom plate 64. In addition, the buffer members 91A and 91B may be fixed to both the bottom wall 72 and the bottom plate 64.

Although, in the exemplary embodiment, the buffer members 91A and 91B, which are constantly in contact with the bottom plate 64 and the bottom wall 72, are disposed on the side of the portion of the bottom plate 64 on the X direction side, which serves as the center of rotation, the buffer members 91A and 91B may be disposed on the side of a portion of the bottom plate 64 on the −X direction side.

Figure 8:
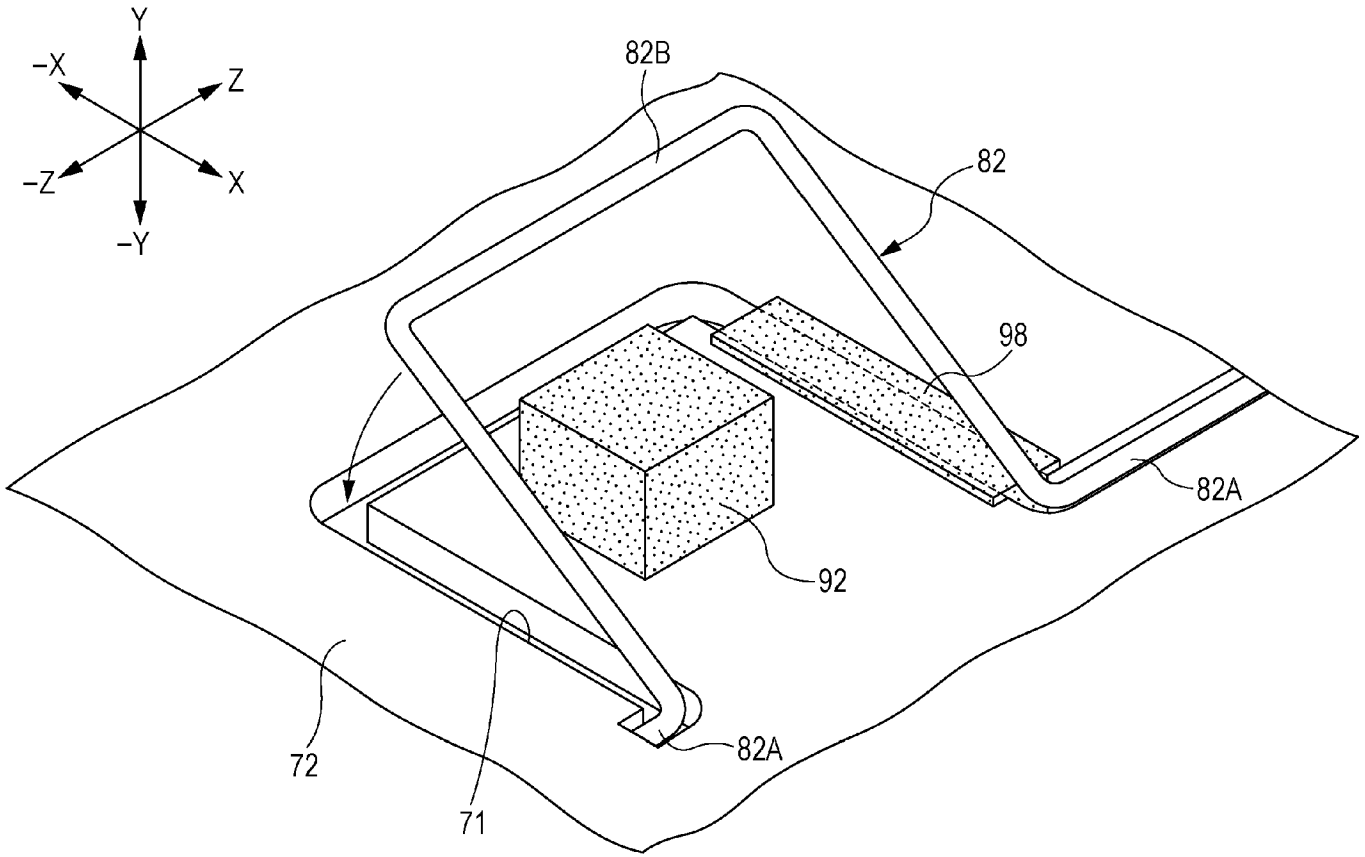
FIG. 8 is a perspective view illustrating a buffer member that is disposed between a lifting member and a bottom wall according to the exemplary embodiment.

In addition, as illustrated in FIG. 8, a buffer member 98 that has a configuration that is similar to those of the buffer members 91A, 91B, and 92 may be disposed in the groove 71 in which the lifting member 82 is to be disposed. In other words, the buffer member 98 may be disposed between the lifting member 82 and the bottom wall 72. As a result, an impact due to collision between the lifting member 82 and the bottom wall 72 of the accommodating portion 70 is reduced. Note that, also in this configuration, it is desirable that the buffer member 98 be constantly in contact with the lifting member 82 and the bottom wall 72.

The exemplary embodiment of the present invention is not limited to the above, and various modifications, changes, and improvement may be made. For example, plural modifications among the above-described modifications may be combined and employed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An accommodating device comprising:

an accommodating portion that includes a bottom portion and in which a member to be accommodated is to be accommodated;

a stacking member that is disposed in the accommodating portion in such a manner that, while one end side of the stacking member serves as a fulcrum, the other end side of the stacking member is able to move upward, and on which the member to be accommodated is to be stacked;

a lifting/lowering mechanism that lifts the other end side of the stacking member and causes the stacking member to drop under a weight of the stacking member by releasing a lifting force;

a first buffer member that acts as a buffer between the stacking member that is to drop under the weight of the stacking member and the bottom portion of the accommodating portion while being constantly in contact with a bottom surface of the stacking member and a top surface of the bottom portion of the accommodating portion within a movable range in which the lifting/lowering mechanism causes the stacking member to move; and a second buffer member that is disposed between a portion of the bottom surface of the stacking member on the other end side and the top surface of the bottom portion and that acts as a buffer between the stacking member and the bottom portion.

2. The accommodating device according to claim 1, wherein the first buffer member is disposed on the one end side of the stacking member and is constantly in contact with the portion of the bottom surface of the stacking member on the one end side and the top surface of the bottom portion of the accommodating portion within a movable range of the stacking member.

3. The accommodating device according to claim 2, wherein a length in a top-bottom direction of the second buffer member in an unloaded state is smaller than a length corresponding to a movable range of the stacking member on the other end side.

4. The accommodating device according to claim 3, wherein the length in the top-bottom direction of the second buffer member in an unloaded state is longer than a length in the top-bottom direction of the first buffer member.

5. The accommodating device according to claim 3, wherein the first buffer member and the second buffer member support the stacking member in a state where the stacking member that has dropped under the weight of the stacking member is separated from the bottom portion.

6. The accommodating device according to claim 4, wherein the first buffer member and the second buffer member support the stacking member in a state where the stacking member that has dropped under the weight of the stacking member is separated from the bottom portion.

7. The accommodating device according to claims 3, wherein the second buffer member is made of a low-resilience material.

8. The accommodating device according to claims 4, wherein the second buffer member is made of a low-resilience material.

9. The accommodating device according to claims 5, wherein the second buffer member is made of a low-resilience material.

10. The accommodating device according to claims 6, wherein the second buffer member is made of a low-resilience material.

11. An image forming apparatus comprising:

an image forming apparatus body;

the accommodating device according to claim 1 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

12. An image forming apparatus comprising:

an image forming apparatus body;

the accommodating device according to claim 2 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

13. An image forming apparatus comprising:

an image forming apparatus body;

the accommodating device according to claim 3 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

14. An image forming apparatus comprising:

an image forming apparatus body;

the accommodating device according to claim 4 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

15. An image forming apparatus comprising:

an image forming apparatus body;

the accommodating device according to claim 5 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

16. An image forming apparatus comprising:

an image forming apparatus body;

the accommodating device according to claim 6 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

17. An image forming apparatus comprising:

an image forming apparatus body;

the accommodating device according to claim 7 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

18. An image forming apparatus comprising:

an image forming apparatus body;

the accommodating device according to claim 8 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

19. An image forming apparatus comprising:

an image forming apparatus body;

the accommodating device according to claim 9 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

20. An image forming apparatus comprising:

an image forming apparatus body;

the accommodating device according to claim 10 that is disposed in the image forming apparatus body in such a manner as to be drawable from the image forming apparatus body, in which the stacking member is configured to drop under a weight of the stacking member as a result of the accommodating device by being drawn from the image forming apparatus body, and in which a recording medium that serves as the member to be accommodated is to be accommodated;

an image forming section that forms an image on the recording medium; and a transport mechanism that transports the recording medium from the accommodating device to the image forming section.

* * * * *